US006612061B2

(12) United States Patent
Janetzke

(10) Patent No.: US 6,612,061 B2
(45) Date of Patent: Sep. 2, 2003

(54) FOLD-A-FRAME

(75) Inventor: Jason Janetzke, Springboro, OH (US)

(73) Assignee: NCR Corporation, Dayton, OH (US)

( * ) Notice: Subject to any disclaimer, the term of this patent is extended or adjusted under 35 U.S.C. 154(b) by 0 days.

(21) Appl. No.: 09/964,943

(22) Filed: Sep. 27, 2001

(65) Prior Publication Data

US 2003/0056415 A1 Mar. 27, 2003

(51) Int. Cl.[7] ..... A47G 1/06

(52) U.S. Cl. ..... 40/789; 40/124.16; 40/124.17; 40/124.19; 40/748; 40/750; 40/751; 40/754; 40/774; 40/786; 40/788

(58) Field of Search ..... 40/124.16, 124.17, 40/124.19, 661.08, 748, 750, 751, 754, 774, 786, 788, 789

(56) References Cited

U.S. PATENT DOCUMENTS 2,479,627 A * 8/1949 Kohl ..... 40/786 X
2,600,429 A * 6/1952 Ranseen ..... 40/661.08
2,652,647 A * 9/1953 Suciu ..... 40/661.08
2,889,646 A * 6/1959 Matthias et al. ..... 40/775
4,237,633 A * 12/1980 Murrell ..... 40/773
4,244,511 A * 1/1981 Coleman ..... 229/92.1
4,450,638 A * 5/1984 Bader ..... 40/774
4,559,727 A * 12/1985 Lewyt ..... 40/773
5,361,521 A * 11/1994 Burtch ..... 40/750
5,439,101 A * 8/1995 Brink et al. ..... 206/45.24
5,678,756 A * 10/1997 Sugiura ..... 229/313
5,822,897 A * 10/1998 Ertzan ..... 40/124.09
5,950,341 A * 9/1999 Cross ..... 40/750

* cited by examiner

*Primary Examiner*—Andrea Chop
(74) *Attorney, Agent, or Firm*—Francis L. Conte

(57) ABSTRACT

A picture frame includes a flat sheet having opposite front and back sides and partitioned into top and bottom pages. The bottom page includes a picture site, and the top page includes a border. The border is sized to frame the picture site upon folding together of the top and bottom pages. A picture is printed on the picture site and is surrounded by the border printed with graphics.

22 Claims, 3 Drawing Sheets

FOLD-A-FRAME

BACKGROUND OF THE INVENTION

The present invention relates generally to stationery products, and, more specifically, to picture frames.

The advent of the digital photographic camera has now made possible the printing of digital photographs using personal computers. The digital photographs are downloaded into the computer and easily printed in conventional printers using ordinary paper. However, photographic-quality printing papers are also available for printing high quality digital photographs at home, without the need for professional printing by photographic laboratories.

Besides merely printing the digital photograph, a consumer may also wish to mount the picture in a custom picture frame with custom matting or borders therefor. The consumer must therefore purchase photo paper, picture frames, and border matting to produce the framed picture in a multistep process with corresponding cost.

Accordingly, it is desired to provide an integrated picture frame permitting direct printing of a picture and border which may be easily folded together in a free-standing product.

BRIEF SUMMARY OF THE INVENTION

A picture frame includes a flat sheet having opposite front and back sides and partitioned into top and bottom pages. The bottom page includes a picture site, and the top page includes a border. The border is sized to frame the picture site upon folding together of the top and bottom pages. A picture is printed on the picture site and is surrounded by the border printed with graphics.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
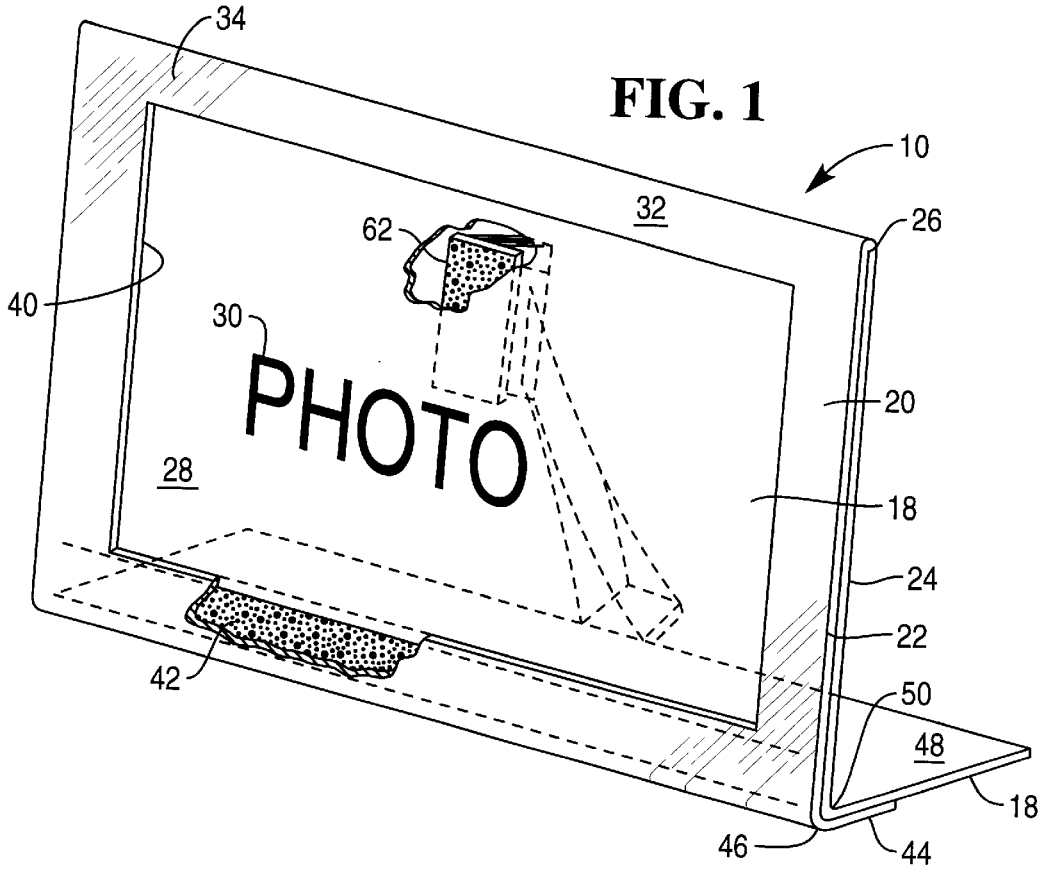
FIG. 1 is an isometric view of a completed picture frame in accordance with an exemplary embodiment of the present invention.
Figure 2:
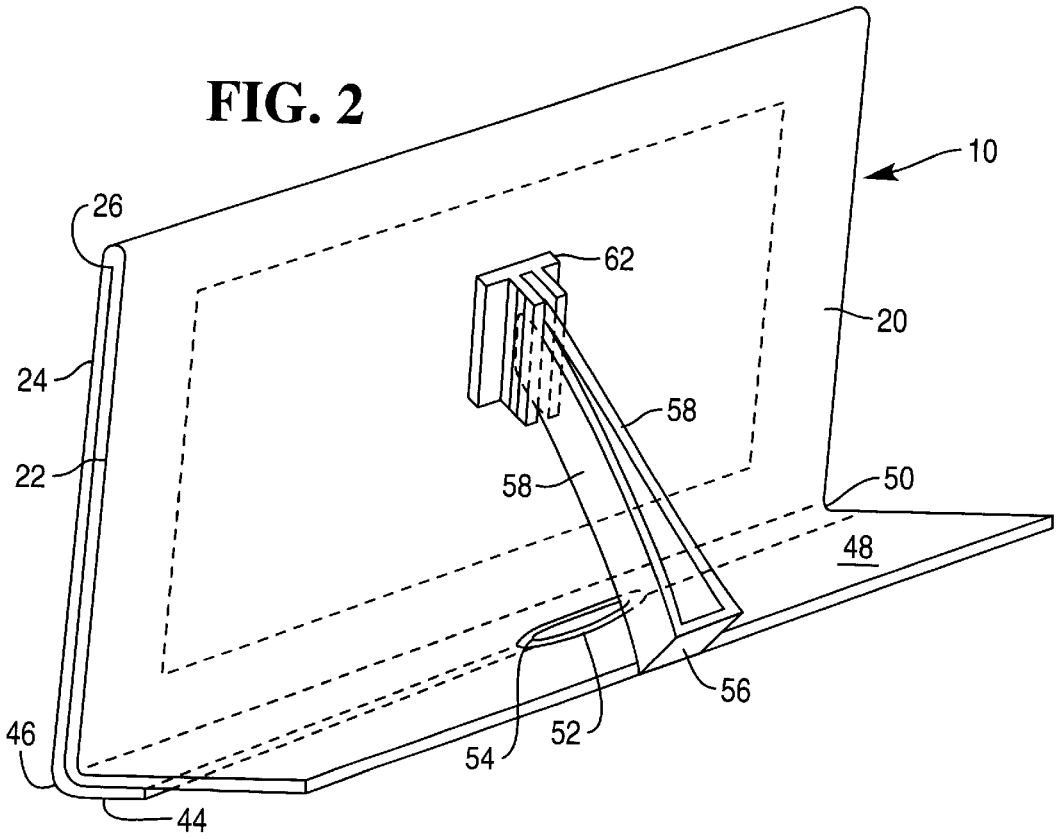
FIG. 2 is an isometric view of the back side of the picture frame illustrated in FIG. 1.

Illustrated in FIGS. 1 and 2 is a completed picture frame 10 in accordance with an exemplary embodiment of the present invention. The picture frame is also referred to as a Fold-A-Frame since it is formed from the flat sheet 12 illustrated in FIG. 3.

Figure 3:
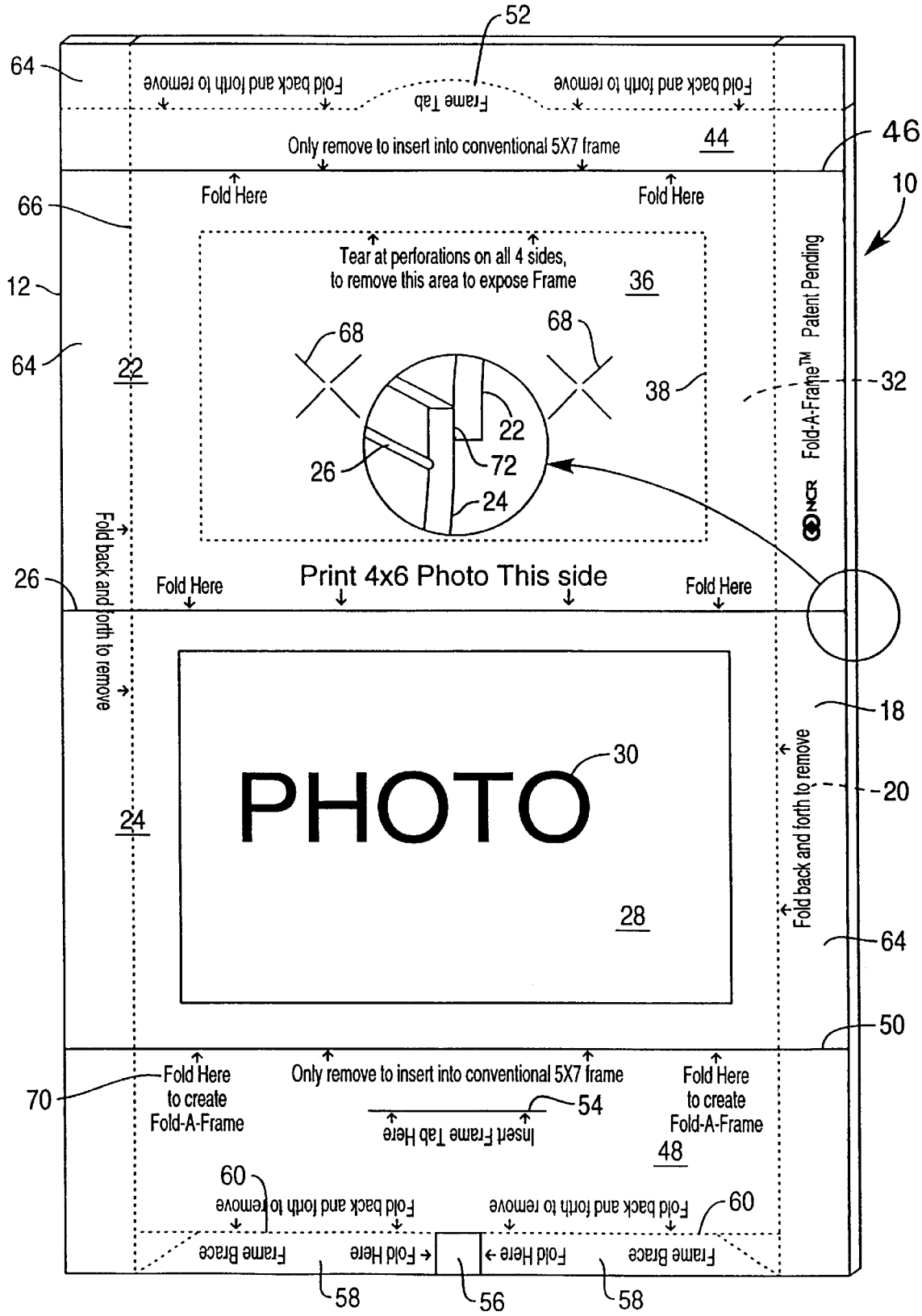
FIG. 3 is a plan view of the front side of the picture frame illustrated in FIGS. 1 and 2 in the initial form of a flat sheet which may be folded to complete the picture frame.
Figure 4:
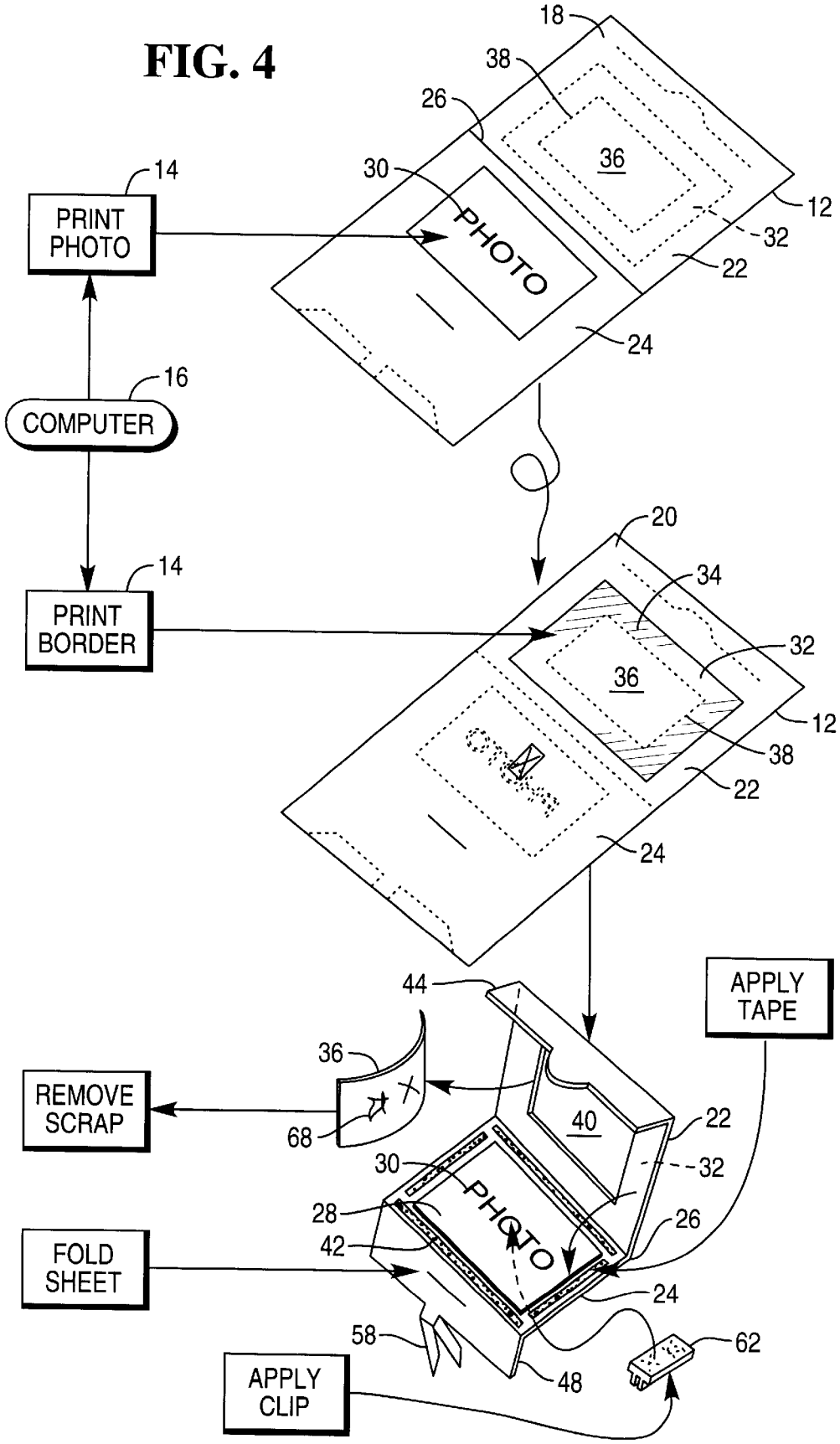
FIG. 4 is a flowchart of an exemplary process of using the picture frame sheet illustrated in FIG. 3 for forming the completed picture frame illustrated in Figures and 1 and 2.

As shown in FIG. 3 the flat sheet 12 may have any suitable material composition such as ordinary paper, but preferably is in the form of photographic-quality paper for use in a conventional printer 14 driven by a typical personal computer 16 as illustrated schematically in FIG. 4.

As shown in FIGS. 3 and 4, the picture sheet 12 has opposite front and back sides 18,20 partitioned into top and bottom pages 22,24 by a horizontal middle fold line 26 therebetween. For example, the fold line may be an indentation or score for permitting accurate straight line folding of the two pages atop each other.

The front side of the bottom page 24 has a rectangular picture site 28 measuring four inches by six inches in a typical standard configuration. The picture site is configured for receiving a printed picture 30 such as a digital photograph thereon.

The back side of the top page 22 has a rectangular frame border 32 or matting for receiving thereon printed graphics 34. The border 32 surrounds a rectangular panel 36 removable along a perforated separation line 38 around the perimeter thereof.

As shown in FIGS. 1 and 4, the rectangular border 32 is sized to surround or frame the picture site 28 upon folding together the top and bottom pages along the middle fold line 26.

FIG. 4 illustrates a preferred method of using the picture frame sheet illustrated in FIG. 3. The computer 16 is loaded with suitable software for use in printing digital photographs downloaded thereto from a conventional digital camera (not shown). The computer is operatively joined to a conventional printer 14 such as a color ink jet printer configured for printing upon ordinary paper or photographic quality paper.

The flat sheet 12 is fed into the printer for printing thereon any desired digital photograph or picture 30 on the picture site found on the bottom page. The sheet is then turned over and fed again into the same printer for printing any desired graphics 34 on the rectangular border 32 found on the back side of the top page. If desired, both sides of the same sheet may be simultaneously printed in a duplex printer specifically configured therefor.

The center panel 36 inside the border 32 may then be removed from the top page by being torn along the perforation line 38, with the panel being discarded as scrap. Removal of the panel creates an open rectangular window 40 sized to surround the rectangular picture site.

The top and bottom pages illustrated in FIG. 4 may then be simply folded together along the middle fold line 26 to frame the picture site 28 with the surrounding border 32 to expose to view the picture 30 through the open window 40, as best illustrated in FIG. 10

As initially shown in FIG. 4, four strips 42 of double-sided adhesive tape are provided for adhesively bonding together the top and bottom pages along the sheet front side behind the border and around the rectangular band surrounding the picture site 28. The top and bottom pages 22,24 are therefore adhesively bonded or laminated together in a two-ply lamination. And, the adhesive strips 42 are conveniently hidden behind the border between the two pages creating an integrated and rigid picture frame with custom printed graphics or matting around the exposed border 32.

As indicated above, the picture frame sheet illustrated in FIG. 4 is preferably in the form of photographic-quality paper on both front and back sides 18,20 thereof. In this way, a photographic-quality digital picture 30 may be printed on the front side of the sheet on the bottom page, and a photographic-quality graphic matting may be printed on the back side of the sheet on the exposed border 32. When the two pages are folded together, both the printed border and printed picture site are exposed to view to the consumer upon removal of the center panel 36.

Computer printing of both sides of the picture frame sheet has unlimited capabilities of appearance and configuration.

For increased contrast, the picture side of the sheet may have a glossy appearance, whereas the back side of the sheet may have a matte finish.

As illustrated in FIG. 3, the top and bottom pages 22,24 may be conveniently sized or configured for providing a two-ply lamination thereof when folded together, with the outer perimeter thereof having the standard five inch by seven inch rectangular configuration which may then be used alone in a conventional 5×7 inch frame.

However, the picture frame sheet 12 may be further configured for use in a free-standing configuration in view of its inherent rigidity. Conventional photographic-quality paper configured for use in color ink jet printers is about 12 mils in thickness and when laminated together in two-plies has a 24 mil thickness which is relatively stiff. Accordingly, this stiffness may be used to advantage to form the free-standing picture frame illustrated in FIGS. 1 and 2.

More specifically, FIGS. 3 and 4 illustrate that the sheet 12 may also include an end flap extending from at least one of the top and bottom pages 22,24 thereof for forming an integral stand to vertically support the folded sheet atop a table or surface. In the preferred embodiment illustrated, the top page 22 includes a top flap 44 extending horizontally along a horizontal top fold line 46 in the form of a score or indentation. And, the bottom page 24 includes a bottom flap 48 extending horizontally along a horizontal bottom fold line 50 also in the form of a score or indentation.

The sheet 12 with the top and bottom flaps 44,48 may be used and printed in the same manner described above, yet after the top and bottom pages are folded together, the top and bottom flaps 44,48 are also folded together and extend obliquely from the folded together pages as illustrated in FIGS. 1 and 2. The folded together flaps and the folded together pages may have an acute included angle between the back sides thereof slightly less than 90 degrees so that the abutting flaps provide a base or stand from which the laminated pages are supported upwardly with a slight backward angle for best viewing by the consumer.

By bonding together the top and bottom pages using the adhesive strips 42 illustrated in FIG. 1, the resulting picture frame has increased structural rigidity sufficient for self-standing atop the laminated flaps. Those flaps may simply be laminated together without adhesive, or adhesive tape may be used therebetween if desired.

As shown in FIGS. 2 and 3, the bottom flap 48 is preferably bigger in the vertical direction than the top flap 44. The two flaps may have the same width as that of the adjoining top and bottom pages with the bottom flap being suitably taller than the top flap.

In this way, the bottom flap 48 illustrated in FIG. 2 extends further rearwardly from the back of the laminated pages than the top flap 44. A wedge-like stand is thusly created. However, the two tabs may have equal size and height, or the top flap may be suitably bigger than the bottom flap in alternate embodiments.

In the preferred embodiment illustrated in FIGS. 2 and 3, the top flap 44 includes an integral arcuate top tab 52 projecting outwardly from the center thereof. And, the bottom flap 48 includes a complementary bottom slit 54 for receiving the top tab upon folding together the top and bottom flaps as illustrated in FIG. 2. The bottom slit 54 may be diecut or formed by perforations which are suitably broken during the assembly process.

In this way, the top tab 52 may be inserted through the bottom slit 54 to mechanically maintain the lamination of the top and bottom flaps for maintaining the collective rigidity thereof for use as a supporting stand.

As shown in FIGS. 2 and 3, the bottom flap 48 may also include an integral rectangular bottom tab 56 projecting outwardly from the center thereof, with a pair of laterally opposite left and right braces 58 being integrally joined to the bottom tab. The braces are continuously joined to the bottom tab, which in turn is continuously joined to the bottom flap. However, the inboard edges of the two braces 58 are intermittently joined to the bottom flap by corresponding perforated separation lines 60.

In this way, the individual braces may be torn from the bottom flap along the perforation lines while remaining firmly attached to the small central bottom tab 56. The bottom tab has three corresponding scored fold lines at the junctions with the braces and the bottom flap to permit bending thereat.

As initially shown in FIG. 4, the two braces 58 may be liberated from the bottom flap during the folding process following printing of the picture and graphics on the sheet, with the braces then being folded together along the bottom tab 56 as illustrated in FIG. 2. The proximal ends of the braces remain integrally attached to the bottom tab 56. And, the braces are sized in length so that their distal ends extend to the back side of the folded bottom page for suitable attachment thereto to provide a rigid brace therefor.

FIGS. 2 and 4 illustrate an adhesive clip 62 for fixedly attaching the braces to the back side of the bottom page. The clip is generally T-shaped in section and has an adhesive head which is readily bonded to the back of the bottom page, with a slot formed between a pair of flanges extending outwardly therefrom. The slot includes friction teeth therein in which the distal ends of the two braces may be inserted for frictional engagement therein. The brace distal ends have a suitable bevel for maximizing the depth of insertion inside the clip due to the triangular configuration of the bottom flap 48, braces 58, and back side of the laminated pages when assembled together. The clip 62 may have any conventional form such as a SuperGrip Sign Holder commercially available from Fasteners For Retailers (FFR) Inc. of Cleveland, Ohio.

As shown in FIG. 3, the picture frame sheet 12 preferably also includes a border tear strip 64 bounding the outboard edges of the top and bottom pages 22,24 and flaps 44,48 along corresponding perforated separation lines 66 therewith. The tear strip fully surrounds the three edges of the sheet up to the distal ends of the two braces 58 along the bottom edge thereof. The tear strip permits full width printing of the graphics on the frame border 32 since typical printers require minimum margins on a sheet within which printing is permitted. During the assembly process illustrated in FIG. 4, the tear strips are readily removed and discarded as scrap prior to the folding process.

As shown in FIGS. 3 and 4, the panel 36 may include finger slits 68 in the form of X's. These slits may be diecut or perforated for permitting the user to punch a finger through the slits for more readily removing the panel from the top page by tearing along the perimeter perforation line 38 provided therefor.

In view of the various features of the single sheet picture frame illustrated in FIG. 3, the sheet is preferably preprinted with use instructions 70 during the commercial manufacture thereof prior to subsequent printing of the picture and graphics by the intended user or consumer. The instructions permit the user to properly orient each side of the sheet for proper feeding through the printer to ensure proper placement of the picture 30 and the border graphics 34.

In its simplest form the picture frame sheet 12 may use solely the top and bottom pages 22,24 folded together in the standard five by seven inch format. The top and bottom flaps and the perimeter strip 64 may all be removed and discarded.

However, additional benefit is provided by retaining the top and bottom flaps for providing the free-standing picture frame illustrated in FIGS. 1 and 2 after assembly thereof.

The single sheet picture frame described above may be used alone or in combination with the separately provided adhesive tape 42 and adhesive clip 62. The two sides of the sheet may be custom printed by the user for any desired picture 30 and border graphics 34. And, if further desired any exposed portions of the two sides of the sheet may be custom printed as desired.

Since both sides of the sheet are printed for creating the picture frame, those sides may have different printing characteristics and different physical attributes as desired. In the preferred embodiment both sides are photographic-quality paper, with the front side having a glossy finish, and the back side having a matte finish.

The exemplary sheet 12 illustrated in FIG. 3 is preferably a unitary sheet of constant thickness throughout. However, FIG. 3 also illustrates an alternate embodiment of the sheet in which the two pages 22,24 may be separate sheets of material adhesively bonded together in a conventional lap joint 72. In this way, each page may have a custom material composition as desired for separately tailoring the frame border 32 and the picture 30 exposed therethrough. The top page 22 which forms the border may therefore be formed of conventional matting papers which may or may not be printed as desired. The lap joined two pages are nevertheless relatively thin and may be fed through a conventional printer for printing either or both sides thereof as desired for enhancing the features of the resulting picture frame following assembly thereof.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims in which I claim:

1. A picture frame for being printed in a computer-driven printer, comprising:

a flat sheet having opposite front and back sides partitioned into top and bottom pages by a horizontal middle fold line therebetween and said front and back sides are plain without adhesive for being fed through said printer;

said bottom page being imperforate and having a picture site on said front side for receiving a picture thereon by said printer;

said top page having a border on said back side for receiving graphics thereon by said printer, and said border surrounds a removable panel along a separation line therebetween; and said border being sized to frame said picture site upon folding together said top and bottom pages along said middle fold line, with said front sides of said folded top and bottom pages facing each other, and said back side border of said top page being exposed to view.

2. A method of using said picture frame according to claim 1 comprising:

printing said picture on said picture site;

printing said graphics on said border;

removing said panel from said top page to form a window therein; and folding together said top and bottom pages along said middle fold line to frame said picture site and expose to view said picture through said window.

3. A method according to claim 2 further comprising adhesively bonding together said top page atop said bottom page in a two-ply lamination.

4. A frame according to claim 1 further comprising said picture printed on said picture site, and said graphics printed on said border.

5. A frame according to claim 4 wherein said sheet comprises photographic-quality paper on both said front and back sides thereof.

6. A picture frame for being printed in a computer-driven printer, comprising:

a flat sheet having opposite front and back sides partitioned into a top page and an imperforate bottom page by a horizontal middle fold line therebetween, and said front and back sides are plain without adhesive for being fed through said printer;

said bottom page having a picture site on said front side for receiving a picture thereon by said printer;

said top page having a border on said back side for receiving graphics thereon by said printer, with said border surrounding a removable panel along a separation line therebetween;

said border being sized to frame said picture site upon folding together said top and bottom pages along said middle fold line, with said front sides of said folded top and bottom pages facing each other, and said back side border of said top page being exposed to view;

a flap extending from at least one of said top and bottom pages along a horizontal fold line for forming a stand to vertically support said folded sheet and display to view said picture site and surrounding border; and a border tear strip bounding outboard edges of said top and bottom pages and flap along corresponding separation lines therewith.

7. A frame according to claim 6 wherein said top page includes a smaller top flap extending horizontally along a top told line.

8. A frame according to claim 6 wherein said bottom page includes a smaller adjoining bottom flap extending horizontally along a bottom fold line.

9. A frame according to claim 6 wherein:

said top page includes a smaller top flap extending horizontally along a top fold line; and said bottom page includes a smaller bottom flap extending horizontally along a bottom fold line.

10. A method of using said picture frame according to claim 5 comprising:

printing said picture on said picture site;

printing said graphics on said border;

removing said panel from said top page to form a window therein;

folding together said top and bottom pages along said middle fold line to frame said picture site and expose to view said picture through said window; and folding together said top and bottom flaps obliquely from said folded together top and bottom pages.

11. A method according to claim 10 further comprising adhesively bonding together said top and bottom pages in a two-ply lamination.

12. A frame according to claim 9 wherein said bottom flap is bigger than said top flap.

13. A picture frame comprising:

a flat sheet having opposite front and back sides partitioned into top and bottom pages by a horizontal middle fold line therebetween;

said bottom page having a picture site on said front side for receiving a picture thereon, and a bottom flap extending horizontally along a bottom fold line;

said bottom flap includes an integral bottom Lab and a pair of opposite braces integrally joined to said tab and intermittently joined to said bottom flap by corresponding separation lines;

said top page having a border on said back side for receiving graphics thereon surrounding a removable panel along a separation line therebetween, and said top page includes a top flap extending horizontally along a top fold line; and said border being sized to frame said picture site upon folding together said top and bottom pages along said middle fold line.

14. A frame according to claim 13 wherein said top flap includes an integral top tab, and said bottom flap includes a complementary bottom slit for receiving said top tab upon folding together said top and bottom flaps.

15. A frame according to claim 14 wherein said sheet further comprises a border tear strip bounding outboard edges of said top and bottom pages and flaps along corresponding separation lines therewith.

16. A frame according to claim 15 wherein said panel includes finger slits therein.

17. A method of using said picture frame according to claim 16 comprising:

printing a picture on said picture site;

printing graphics on said border up to said tear strip;

removing said panel from said top page to form a window therein;

removing said tear strip from said sheet;

folding together said top and bottom pages along said middle fold line to frame said picture site and expose to view said picture through said window; and folding together said top and bottom flaps to insert said top tab into said bottom slit.

18. A method according to claim 17 further comprising:

liberating said braces from said bottom flap and folding said braces along said bottom tab; and attaching said folded braces to said back side of said bottom page.

19. A method according to claim 17 further comprising:

punching said panel through said finger slits to remove said panel from said top page;

adhesively bonding together said top and bottom pages in a two-ply lamination; and clipping together distal ends of said braces in adhesive attachment to said back side of said bottom page.

20. A frame according to claim 15 wherein said sheet includes preprinted use instructions.

21. A frame according to claim 15 further comprising a plurality of double-sided tape strips for adhesively bonding together said top and bottom pages along said front side behind said border.

22. A frame according to claim 15 further comprising an adhesive clip including a slot for receiving distal ends of said braces for adhesive bonding to said back side of said bottom page.

* * * * *

UNITED STATES PATENT AND TRADEMARK OFFICE

CERTIFICATE OF CORRECTION

PATENT NO. : 6,612,061 B2
DATED : September 2, 2003
INVENTOR(S) : Janetzke, J.

It is certified that error appears in the above-identified patent and that said Letters Patent is hereby corrected as shown below:

Column 6,
Line 54, delete “claim 5” insert -- claim 9 --

Signed and Sealed this

Sixth Day of January, 2004

JAMES E. ROGAN
*Director of the United States Patent and Trademark Office*